US006558530B2

(12) United States Patent
Schlosser et al.

(10) Patent No.: US 6,558,530 B2
(45) **Date of Patent: *May 6, 2003**

(54) PROCESS FOR THE FLUID CATALYTIC CRACKING WITH PRE-VAPORIZED FEED

(75) Inventors: Claudio Romeo Schlosser, Petrópolis (BR); Andrea De Rezende Pinho, Rio de Janeiro (BR); Carlos Guerra Pereira, Rio de Janeiro (BR)

(73) Assignee: Petroleo Brasileiro S.A.-Petrobas, Rio de Janeiro (BR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,432

(22) Filed: Sep. 2, 1999

(65) Prior Publication Data

US 2002/0005375 A1 Jan. 17, 2002

(30) Foreign Application Priority Data

Dec. 29, 1998 (BR) ..... 9805727

(51) Int. Cl.[7] ..... C10G 11/00
(52) U.S. Cl. ..... 208/113; 208/153; 208/157
(58) Field of Search ..... 208/113, 153, 208/157

(56) References Cited

U.S. PATENT DOCUMENTS

| | | | | | |
|---|---|---|---|---|---|
| 4,097,243 | A | * | 6/1978 | Bartholic | 208/113 |
| 4,332,674 | A | * | 6/1982 | Dean et al. | 208/120.01 |
| 4,578,183 | A | | 3/1986 | Chou et al. | 208/113 |
| 4,725,408 | A | * | 2/1988 | Pratt et al. | 422/144 |
| 4,749,470 | A | * | 6/1988 | Herbst et al. | 208/85 |
| 4,980,051 | A | | 12/1990 | Owen | 208/113 |
| 4,985,136 | A | | 1/1991 | Bartholic | 208/153 |
| 5,271,826 | A | | 12/1993 | Krambeck et al. | 208/113 |
| 5,324,418 | A | | 6/1994 | Muldowney | 208/120.01 |
| 5,324,419 | A | | 6/1994 | Muldowney | 208/120.01 |
| 5,951,850 | A | * | 9/1999 | Ino et al. | 208/120.01 |
| 6,059,958 | A | * | 5/2000 | Ramos et al. | 208/113 |

FOREIGN PATENT DOCUMENTS

| | | | |
|---|---|---|---|
| EP | 0892031 A2 | | 1/1999 |
| GB | 2075048 | * | 11/1981 |
| GB | 2100747 | * | 1/1983 |
| WO | WO 8504182 A1 | | 9/1985 |
| WO | WO95/04182 | | 9/1985 |
| WO | WO88/01638 | | 3/1988 |

OTHER PUBLICATIONS

"Some Fundamental Aspects of Residuum Catalytic Cracking", Yang Guanghua et al., ACTA Petrolei Sinica, Oct. 1997, pp. 12–16.

* cited by examiner

*Primary Examiner*—Walter D. Griffin
(74) *Attorney, Agent, or Firm*—Sughrue Mion, PLLC

(57) ABSTRACT

A process for the catalytic cracking in a fluidized bed where the feed stock is fully and previously vaporized before made to contact the cracking catalyst which has its origin in the regenerator. The pre-vaporization of the feed dispenses with the heat exchange with the catalyst in order to vaporize the feed. Thus, coke deposits on the catalyst surface are reduced, the yield of the gasoline unit is improved and the unit may operate under very low contact times (<0.5 seconds). Modes for adjusting the heat balance of the unit as a function of the increase in the feed temperature without harm to the catalyst circulation are also presented.

29 Claims, 5 Drawing Sheets

PROCESS FOR THE FLUID CATALYTIC CRACKING WITH PRE-VAPORIZED FEED

FIELD OF THE INVENTION

The present invention relates to a process for the fluid catalytic cracking which is improved by the pre-vaporization of the hydrocarbon feed that is to be cracked in the catalytic cracking unit. More specifically, the present invention relates to a process for the catalytic cracking in a fluidized bed where the feed is completely and previously vaporized before it is made to contact the hot cracking catalyst from the regenerator vessel. In terms of the vaporization of the feed the pre-vaporization of the feed dispenses with the heat exchange with the catalyst, so that coke deposits on the catalyst particles are minimized.

BACKGROUND INFORMATION

Fluid catalytic cracking (FCC) is a process of paramount importance for obtaining valuable oil products such as gasoline, diesel oil and liquefied petroleum gas (LPG).

In spite of the fact that the FCC process has been known for more than 50 years, new, improved techniques are continuously sought which could improve the process, so as to increase the yield in more valuable products. Broadly speaking, it is common knowledge that the main object of the FCC processes is the maximization of more valuable products.

Generally, the feed stocks which are more usually submitted to the FCC process are those refinery streams from side cuts of vacuum towers, the so-called vacuum heavy gasoil (VHGO), or streams which are heavier than the former, from the bottom of atmospheric towers, the so-called atmospheric residue (AR), or still, mixtures of such streams. When submitted to the FCC process, such streams are made to contact a catalyst made up of fine particulate material in a conversion zone, in the absence of hydrogen, so as to be converted into lighter and more valuable hydrocarbon streams.

According to the state-of-the-art FCC process, it is only when the feed is made to contact the regenerated hot catalyst that heat transfer occurs so as to attain the required temperatures to vaporize the feed and effect the cracking reactions.

A well-known aspect of the process is the initial contact of the catalyst and the feed, which has a decisive influence on the conversion and selectivity to noble products.

Improvements in the contact between catalyst and feed have been tried, always aiming at promoting a quick vaporization of the feed and an intimate contact with the catalyst in the short time available in the reaction zone, which averages 2 seconds. In the reaction zone, the catalyst may flow upstream (riser) or downstream (downer).

In order that the catalytic reactions be processed, it is necessary that the vaporization of the feed and catalyst in the mixing area occurs in a few milliseconds, so that the molecules of vaporized hydrocarbons may contact the catalyst particles, permeate its micropores and be influenced by the acidic sites of the catalyst which cause the catalytic cracking.

In case a quick vaporization is not reached, the thermal cracking of the liquid portions of the feed is observed. It is well known that thermal cracking leads to by-products such as coke and fuel gas, mainly for residua-containing feeds. Therefore, thermal cracking on the basis of the reaction zone undesirably competes with the catalytic cracking aimed by the process.

A better vaporization will be obtained if the feed is properly vaporized so as to form a fine spray on the catalyst phase. In order to obtain such spray several models of feed atomizer in the reaction zone have been developed, for example, the ULTRAMIST atomizer developed by PETROBRAS. A really efficient system for atomizing the feed would yield a spray having particles fine enough so that 90% of the feed could be vaporized in less than 0.1 seconds, preferably in less than 0.05 seconds, considered from the moment of the injection of the feed in the reaction zone.

A further important parameter in the atomization of the feed is the temperature of the feed in the atomizer. The higher the temperature of the feed in the atomizer, the higher will be the surface area of the droplets in the spray, and therefore the higher will be the contact area between the feed and the catalyst, with significant impact on the ease of vaporization.

For the residual feeds used in the FCC process and for the temperature ranges practiced, it can be seen that the increase in the contact area by using higher temperatures of the feed may attain 30%.

In the industrial furnaces used for pre-heating the feed of the FCC unit, the temperature is limited to 300° C., which is insufficient to vaporize it. It is obvious that the feeds of the FCC unit cannot be indefinitely heated since the excessive heating would cause the thermal cracking and the coking of the furnaces.

Therefore, although desirable, the complete vaporization of the feed does not occur in an efficient way in the conventional FCC units, mainly in those, which operate with heavy gasoil or atmospheric residua, or even with a mixture of these feeds. The contact of the feed, which is not completely vaporized, with the hot catalyst eventually results in the deposition of liquid droplets of the feed on the surface of catalyst particles, so that coke production is increased.

Only the pre-vaporization of the feed to the FCC unit would prevent the deposition of liquid on the catalyst particles and eliminate the negative effects of such deposition. The specialized literature, however, has not focused this matter, the subject of choice being the atomization or the pre-treatment of the feed.

One point, which has not received much attention from the experts in the fluid catalytic area, is that if the heating of the feed up to the point of complete vaporization before contacting the regenerated catalyst could bring further benefits to the FCC process.

The complete vaporization of the feed seems to be actually necessary. A few studies show that, even at the high temperatures found in the reaction zone, the feed may "wet" the hot catalyst particles and be sucked by its pores through a capillary action, whereby coke is formed. The estimated time of suction, through capillary action of the liquid present in the surface into the interior of the pores is of the order of 0.1 seconds, this figure being frequently lower than the time required for the complete vaporization of the liquid.

G. Yang et al. in "Some Fundamental Aspects of Residuum Catalytic Cracking", Acta Petrolei Sinica (Petroleum Processing Section), October, 1997, pages 12–16, collected catalyst samples at various heights of the reaction zone (riser) of an industrial FCC unit and assessed the carbon content and the microactivity (MAT) of such samples. The results indicate that at 1.0 meter height up to the point of feed injection, the carbon content rises steeply from 0.2 to 2.71 weight %, while MAT activity decreases from 65.9 to 28.1 percent. The coke content of samples from a higher point, at 3.3 meters in the reaction zone (riser) decreases up to 1.01 weight %, the MAT activity is partially recovered, and attains 45.9%. Above this point, carbon and MAT activity are only slightly altered.

To explain these results, the experts assumed that the catalyst coverage by carbon and the filling of the catalyst pores with droplets of liquid feed lower the catalyst activity, the portion of the feed, which is not vaporized being considered as coke. The reactions of the non-vaporized feed proceeding throughout the reaction zone (riser), the catalyst surface and the MAT activity are in part recovered.

Therefore, these observations have led the Applicant to infer that the complete vaporization of the feed of the FCC unit, before the contact with the regenerated catalyst may bring additional benefits to the FCC process, besides those obtained by just the increase in the feed temperature.

However, in spite of several clues as to the importance of the complete vaporization of the feed for the FCC units, the patent literature focuses the solution of the problem of heavy feed cracking on other issues.

U.S. Pat. No. 5,324,418 and U.S. Pat. No. 5,324,419 suggest to make closer the temperature of the regenerated catalyst and the feed by pre-heating the feed at high temperatures (around 426° C.), the use of catalyst coolers (catcoolers) and high catalyst/oil ratios to define a new operation window in a FCC unit where the product yields would be optimized.

U.S. Pat. No. 5,271,826 teaches an FCC process which is typical of heavy feeds in which the feed is heated through the contact with the hot catalyst at a temperature of ca. 565° C. so as to promote the thermal as well as the catalytic cracking of the feed, and adopts a quick cooling or quench proceeding with a lighter feed in an intermediate section of the reaction zone (riser) to quickly cool the mixture and catalytically control the cracking process.

U.S. Pat. No. 4,980,051 teaches a process for the pre-treatment of a residuum-containing feed in which the heating of the feed to the FCC unit occurs through direct transfer of heat through the contact between the feed and the reaction products. However, the thermal exchange through direct contact only heats the feed before the contact with the catalyst.

WO patent 88/01638 teaches that it is possible to pre-treat heavy hydrocarbon feeds lean in hydrogen such as atmospheric residua by using state-of-the-art processes such as visbreaking or hydrotreating before the catalytic cracking process. There are also comments on the use of non-conventional sources of energy, such as a microwave generator, for heating the feed. In spite of the relatively higher price, these non-conventional energy sources may heat preferably different portions of the heavy hydrocarbon feed, being more selective than a conventional thermal pre-treatment.

WO patent 85/4182 also describes the pre-treatment of the feed before submitting it to the FCC process. The pre-treatment aims at substantially lowering the contents of heavy metal contaminants as well as most of the coke precursors. The pre-treatment of the feed is coupled in the vicinity of the catalytic cracking reactor such as the product which leaves the pre-treatment system is in the gas phase, at a temperature between 371 and 593° C. In view of the reduction in coke precursors effected in the feed, such an arrangement allows a more efficient use of energy and a better catalytic cracking.

Thus, the patent literature indicates that the issue of the cracking of heavy feeds has been addressed by indirect ways, such as the pre-treatment of the feeds, with separation of the coke precursors previous to submitting the feeds to the FCC process. However, this approach involves the extra cost of a further unit coupled to the FCC unit, which may not be economically interesting to the refiner.

Another approach to the heavy feed cracking is presented in U.S. Pat. No. 4,985,136. This patent teaches an FCC unit, which operates under crossed flow between a downward catalyst panel and the hydrocarbon feed. The main feature of this publication is the extremely low contact time between the feed and the regenerated catalyst, which under optimum conditions will be lower than 0.5 seconds, more preferably between 0.1 to 0.2 seconds. The main advantage of this system would be to eliminate back mixing of the catalyst—which is colder—with the feed or with reaction products, so as to avoid secondary, undesirable side reactions, which yield less noble products.

However, the point which could be considered as an advantage of the cited U.S. document, that is, the very low contact time, is actually a drawback of the technology described therein. An extremely low contact time will certainly be lower than the time required for the vaporization of the feed, this leading to large amounts of coke on the catalyst since, still according to the teachings of U.S. Pat. No. 4,985,136, the vaporization of the feed would be obtained by direct heating with the regenerated catalyst. However, as is well known by the experts, the complete vaporization of heavy feeds such as those described in that European document is not so immediate nor so efficient as desired, the point of the vaporization of the feed being approached only under conventional ways, that is, through heat exchange with the hot regenerated catalyst.

For the new FCC units operating at extremely low contact times between catalyst and feed, it is probable that the pre-vaporization of the feed turns out to be a very important feature, perhaps it constitutes even the necessary condition to allow the operation under such reduced contact times.

On evaluating the pre-vaporization of the feed to the FCC unit, another important feature is the adjustment of the heat balance of the unit. As the FCC unit operates under heat balance, it is obvious to the experts that the increase in the temperature of the feed entails the modification of the flow rate of regenerated catalyst to the reaction zone or still the temperature of the regenerator in order to keep the heat balance of the unit.

In order to keep the heat balance of the unit in spite of the increase of the temperature of the feed, the circulation of regenerated catalyst to the reaction zone should be reduced, as a result of the reduction of heat requirement. Even in the case the temperature of the regenerator were kept constant with the aid of a catalyst cooler, still the circulation of regenerated catalyst to the reaction zone should be reduced. In order to keep the same circulation of regenerated catalyst, the regenerator temperature should be reduced to figures much lower than those required to a proper regeneration of the catalyst (that is, coke content lower than 0.05%), with obvious losses for the refiner.

One approach to the adjustment of the thermal balance of the FCC unit is described in EPC patent application 97307435.4 (USA application 199708/933,006) of the Applicant and herein fully incorporated as reference, which consists in rendering possible that the temperature of the feed varies by keeping the regeneration temperature constant and at the ideal value. Contrary to the state-of-the-art techniques, the suggested technique keeps also constant and at the ideal values the circulation of regenerated catalyst.

This way the operation of the FCC unit with pre-vaporized feed is rendered fully operative, without any harm to the catalyst/oil ratio.

Thus, the question of the pre-vaporization of the feed to the FCC unit has not been the object of the experts efforts as is proposed in the present application, which suggests as a solution for the cracking of heavy feeds in a FCC unit, the pre-vaporization of the feed before the contact with the regenerated catalyst, so as to obtain better yields than in the FCC units which operate in the conventional mode as well as making possible that such units operate under extremely low contact time.

SUMMARY OF THE INVENTION

The present invention comprises a process for the fluid catalytic cracking designed for the cracking of hydrocarbon feeds which are normally used in the refinery, besides heavier feeds, that is, those where the boiling point of a substantial portion of the feed is above 580° C. The invention makes possible a higher gasoline production, this entailing better economics of the process.

The process of the present invention for the fluid catalytic cracking of hydrocarbon feeds, under conditions of fluid catalytic cracking, in the absence of added hydrogen, and operating under a heat balance regimen comprises the following steps:

- Pre-vaporizing the feed under conditions of temperature and pressure required to promote the optimized vaporization of the feed prior to the contact with the hot regenerated catalyst;
- In the reaction zone, make to contact the pre-vaporized feed with the catalyst stream from the regenerator so as to promote the catalytic cracking reactions in the vapor phase under reduced deposition of coke on the catalyst, whereby is obtained a mixture of cracked hydrocarbons and spent catalyst;
- From the so-obtained mixture, separating a stream of spent catalyst, with the aid of suitable devices placed after the reaction zone, and a stream of cracked hydrocarbons;
- Directing the spent and separated catalyst from the previous step to a stripping zone, then to a regeneration zone and effect the combustion of the coke deposited on the catalyst particles, so as to yield particles of regenerated catalyst whose activity is higher than that of the spent catalyst;
- Directing the stream of cracked hydrocarbons to the separation and fractionation zone, so as to separate the various products obtained according to their boiling points;
- Directing the stream of regenerated catalyst back to the reaction zone so as to continue the process of fluid catalytic cracking.

Thus, the present invention provides for a FCC process for the cracking of hydrocarbon feeds having high-end boiling point where the production of gasoline is increased relative to state-of-the-art techniques.

The present invention provides further a FCC process which operates with the pre-vaporized feed before the contact with the catalyst so as to dispense with the use of atomizers for the feed, since said feed is already completely vaporized this rendering possible to work under extremely low contact times between feed and catalyst since a period of time for vaporizing the feed will no longer be required.

The present invention provides further a FCC process which operates with the pre-vaporized feed in which the amount of heat transferred from the catalyst to the feed is that required just for facing energy requirements of the cracking process, which is endothermic, the energy expenditure brought by the catalyst for vaporizing the feed being no longer required.

The present invention allows the optimization of the regenerator temperature as well as of the catalyst flow rate to the reaction zone, this rendering possible the control of the circulation of regenerated catalyst independently from the feed temperature which is already pre-vaporized.

The operation of a FCC unit with a pre-vaporized feed allows the work of the regenerator at temperatures lower than those employed in conventional FCC units which process heavy feeds, resulting in lower catalyst deactivation and consequently in an operation which is economically more advantageous to the refiner.

The present invention provides further a process for the pre-vaporization of the feed where the energy required for pre-vaporization may be partially or completely provided by the heat exchange between the hydrocarbon feed and the catalyst cooler, so as to optimize the unit costs.

DETAILED DESCRIPTION OF THE INVENTION AND PREFERRED MODES

Figure 1:
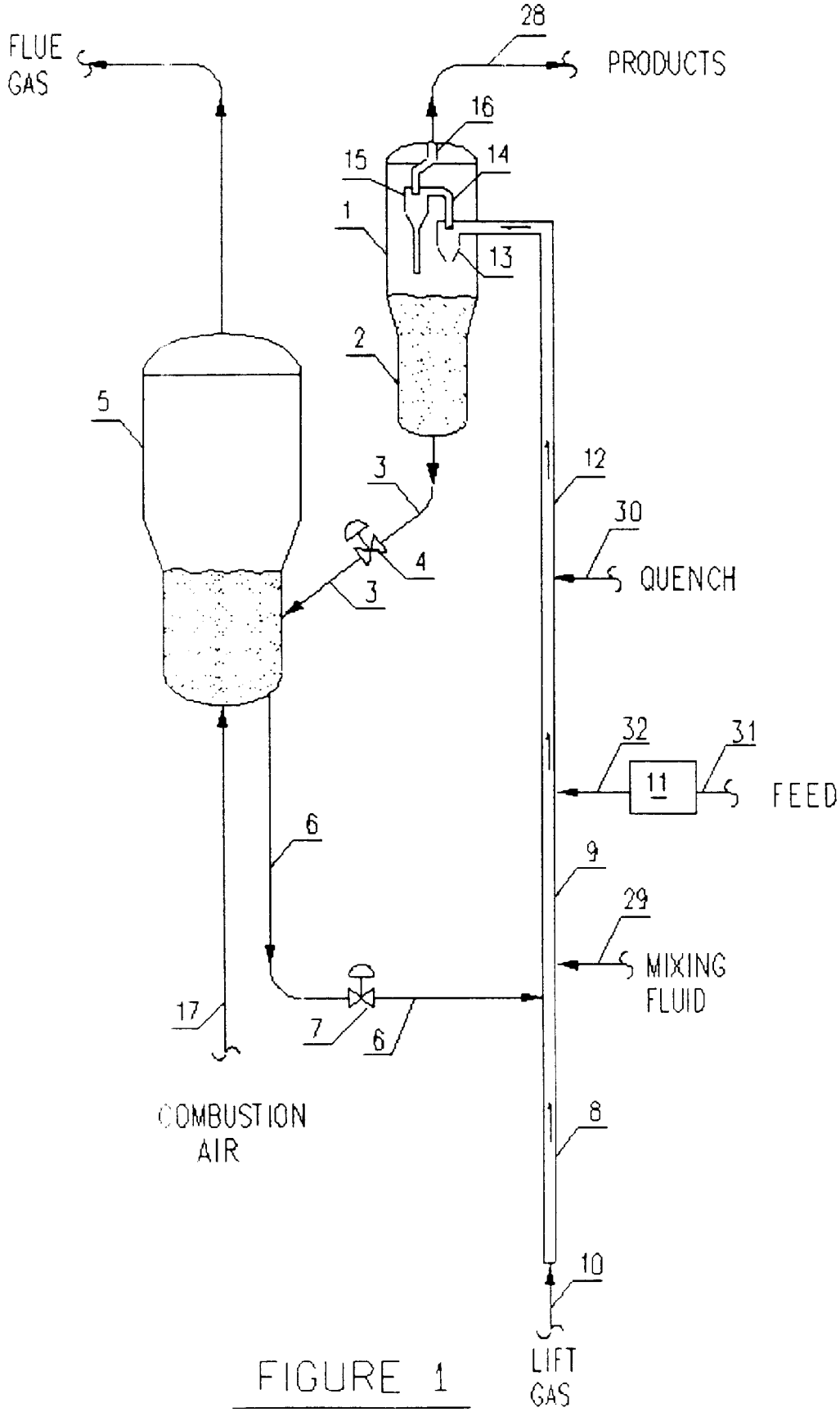
FIG. 1 illustrates one of the preferred modes of the present invention for the adjustment of the heat balance of the FCC unit operating with the pre-vaporized feed, where the control of the final reaction temperature is attained through a quick cooling (quench) by heat exchange with a stream of cooling fluid.

The present invention relates to a process for the fluid catalytic cracking of hydrocarbon feeds normally processed in refineries, the feeds being originated in the processing of petroleum oil or of shale oil, specially the heavier feeds, that is, those where the boiling point of a substantial portion of the feed is higher than 580° C., such as gasoil, heavy gasoil, atmospheric residua and mixtures of these feeds.

The main feature of the present process is that it makes the pre-vaporized feed to contact the cracking catalyst, so as to eliminate the need of heat exchange between the feed and the hot regenerated catalyst for the heating and the vaporization of the feed, therefore minimizing the deposition of liquid on the catalyst particles and the subsequent formation of coke and loss of catalyst activity.

Generally, the process which is described and claimed in the present invention comprises treating a pre-vaporized hydrocarbon feed with a stream of regenerated catalyst which is relatively hotter than the pre-vaporized feed, so as to secure the energy required for the cracking reactions, such reactions being endothermic.

The fluid catalytic cracking process of the present invention accepts the use of several feeds normally encountered in the refineries. Examples of feeds are gasoil, the heavy gasoil (VHGO), the atmospheric distillation residua (AR), and gasoil from the treatment of shale oil, the mixture of these feeds being also commonly practiced in the refineries.

A typical refinery feed is shown in TABLE 1. From this TABLE it can be seen that this is a heavy feed, since its final boiling point is 588° C. while the API degree is 18.6.

TABLE 1

| Characterization Parameters of a Heavy Gasoil | |
|---|---|
| API | 18.6 |
| Density 20/4° C. (° C.) | 0.9391 |
| Aniline Point (ppm) | 93.2 |
| Total Nitrogen (ppm) | 3069 |
| Basic Nitrogen (ppm) | 1001 |
| Ramsbottom Carbon (wt %) | 0.58 |
| Insoluble in n-heptane (wt %) | <0.1 |
| Sulfur (wt %) | 0.63 |
| Polyaromatics (wt %) | 29 |
| Kinematic Viscosity (ASTM D445) (cSt) @ 60° C. | 95.95 |
| **Simulated Distillation** | |
| PIE (° C.) | 325 |
| 5% (° C.) | 363 |
| 10% (° C.) | 386 |
| 50% (° C.) | 467 |
| 90% (° C.) | 542 |
| PFE (° C.) | 588 |
| **Metals (FRX)** | |
| Ni (ppm) | 620 |
| V (ppm) | <200 |
| Na (ppm) | 460 |
| **$C^{13}$ Analysis (RMN)** | |
| Aromatic Carbon (wt %) | 18.1 |
| Saturated (wt % | 91.9 |
| C/H ratio | 0.5496 |

TABLE 1 lists results of analysis which are normally run for characterizing hydrocarbon feeds, such as simulated distillation, API degree, metals analysis through X ray fluorescence (FRX), as well as the analysis of kinds of carbon (aromatics and saturated), by means of C-13 nuclear magnetic resonance.

The degree of vaporization of the feed to the FCC unit may be calculated with the aid of the PETROBRAS SIMCRAQ$^{OT}$ simulator. The use of this simulator leads to the evaluation of the optimized condition for the vaporization of a certain feed.

It is obvious for the experts in the field of catalytic cracking that pressure is a parameter of paramount importance for the vaporization of the feeds to the FCC unit. Studies with the simulator allow a good estimate of the influence of pressure on the vaporization of a certain feed.

Different and various kinds of sources of energy may be employed for the vaporization of the feed of the FCC unit, the specific kind of said source does not constituting a limiting feature of the present process.

Thus, according to one preferred mode of the invention, the feed to the FCC unit is vaporized by means of a radiation in the infrared region, with a narrow wavelength, an infrared oven being used for the vaporization.

A further preferred mode of the invention combines several non-conventional sources of energy, such as microwaves, with other, conventional sources of energy, in order to increase the efficacy of the heating, so as to minimize the coking of the feed.

Still another mode of the invention is the replacement of the conventional furnaces of the FCC unit by other, more efficient ones, such as the furnaces of the coke units and of the visbreaking units, or still the double fired furnaces so as to accelerate the heating and the vaporization of the feed without forming coke.

Double fired furnaces are special furnaces where each row of tubes of the radiation chamber is placed between two rows of burners, so as to attain a more uniform distribution of heat around the circumference of each tube, with the consequent quicker heating of the feed and lower coke production.

Once the feed is vaporized, the streams of vaporized feed and regenerated catalyst are made to contact the reaction zone. Through the contact of the feed with the catalyst, the hydrocarbons present in the feed are cracked, with the consequent deposit of the by-product of the cracking reactions—coke—on the catalyst particles. There is a partial loss of activity of the catalyst which is then said to be a spent catalyst.

The catalyst used for cracking the hydrocarbon feed may comprise any catalyst which is usually employed in the FCC technique. Preferred catalysts are those which have in their composition the crystalline aluminosilicates known as zeolites, this choice being due to their high intrinsic activity and resistance to the deactivating effects from exposition to high temperature vapor and metals. Normally the catalyst composition comprises further a porous inorganic matrix such as silica, silica-alumina, or zirconia. The zeolite content in the FCC catalyst may attain 25% or more, by weight. Also usual are FCC catalysts where the zeolite has been rare-earth exchanged, in contents varying between 0 and 16 weight %, according to the catalyst type.

After the reaction zone, a stream of cracked hydrocarbons is separated from the catalyst. The cracked hydrocarbons constitute the reaction product and are directed to the fractionating systems. The spent catalyst is directed to a stripper vessel for the recovery of a few reaction products which otherwise would be entrained to the regenerator, and thereafter to the regeneration zone.

In the regeneration zone the combustion of coke deposited on the catalyst particles is effected aiming at the recovery of the activity of the catalyst as well as at obtaining particles of regenerated catalyst at high temperature, the heat content of which is mostly consumed in the reaction zone to satisfy the heat demand of the catalytic cracking reactions, which are for the most part endothermic.

The combustion of the coke deposited on the FCC catalyst may be obtained in a regime of total or partial combustion. The FCC units which operate with heavy feeds normally work in a regime of partial combustion, the regenerated catalysts containing less than 0.07 and preferably less than 0.05 weight % of coke.

In a standard regeneration operation in a FCC unit which operates with heavy feeds, such as a vacuum residuum (VR), for example, the contents in contaminant metals in the spent catalyst are much higher than those present in a FCC operation with light feeds or having low metal content.

The contaminant metals normally classed as catalyst poisons are, chiefly, vanadium, nickel, sodium and iron. It is well-known that vanadium is one of the main poisons for the cracking catalyst since it reacts with the zeolite and destroys its crystalline array, with the consequent loss in catalyst cracking activity.

The deleterious effects of vanadium are evidenced during the regeneration step, when the vanadium deposited on the catalyst reacts with water vapor yielding a volatile vanadium compound which not only attacks the zeolite of the catalyst particle where it is present but may also migrate from one particle to another, increasing the destruction ability of vanadium. It is obvious for the experts in the area, that the higher the vanadium content and the regeneration temperature, the higher will be the destruction ability of the vanadium on the catalyst.

Advantageously, by pre-vaporizing the feed, as described and claimed in the present invention, the operation of the regenerator of the FCC unit which processes heavy feeds may be effected at lower temperatures than those usually practiced, this favoring the catalyst activity. This will be possible since with the pre-vaporized feed, it will no longer be necessary that all the heat for the feed vaporization is provided by the burning of coke in the regenerator, this rendering possible a regeneration temperature which is less harmful to the cracking catalyst.

Besides, as the heat requirement for the feed vaporization in the reaction zone is non-existent, the exceeding energy which is not required for securing the cracking reactions may be employed, in one of the preferred modes of the invention, for pre-vaporizing the feed, so as to adjust the heat balance of the FCC unit.

A further important advantage of the present invention due to the fact of the feed being previously vaporized before the contact with the catalyst, is the possibility of significant reduction of the contact time between the catalyst and the vaporized feed, making the most of all the catalyst potential, which is then no longer just a heat carrier, this in turn rendering possible the operation of new FCC units operating at extremely low contact times (<0.5 seconds).

The use of pre-vaporized feed for the FCC unit may result in an increase in the final reaction temperature. It is obvious for the experts in the area that an increase in the feed temperature and the consequent increase in the final reaction temperature would force a reduction in the catalyst/oil ratio, this being undesirable to the refiner.

In order that the temperature of the feed may be increased, without harm to the catalyst/oil ratio, other measures should be taken to secure the heat balance of the unit, those being described in the modes of the invention better characterized in conjunction with the attached FIGURES.

FIG. 1 illustrates one of the modes of the present invention when the heat balance of the FCC unit which operates with the pre-vaporized feed is controlled through the use of a stream of fluid quench for the control of the final reaction temperature.

According to FIG. 1, the FCC process according to the present invention comprises a reactor (1), a regenerator (5), and a reaction zone (12) with upward catalyst flow, which provides a conversion zone.

The catalyst circulation and the contact of same with the pre-vaporized feed proceed as follows:

Thus, from regenerator (5) extend: a standpipe (6) which conveys hot regenerated catalyst through control valve (7) to the lower section (8) of the reaction zone.

Lift gas is introduced via conduit (10), and is made to contact the catalyst in the lower section (8) of the reaction zone so as to keep the catalyst in a fluidized state.

The distribution of the lift gas in section (8) of the reaction zone is preferably effected by means of a perforated ring or still by a perforated plaque, those being typical distribution devices, well-known by the experts in the field.

In order to secure a thorough and quick mixture of the catalyst from the regenerator and the feed it is usual to inject a mixing fluid (29) in the middle section (9) of the reaction zone. The mixing fluid may be steam or another gaseous fluid, such as fuel gas.

The stream of hydrocarbon feed (31) is made to go through a heating system, which may be a conventional furnace of a delayed coking unit, an infra red furnace, or even a combination of kinds of conventional and non-conventional heat sources (11), where said stream is vaporized at a temperature which may vary between 350 and 650° C., more preferably between 400 and 550° C., resulting in stream (32) of a pre-vaporized hydrocarbon stream.

The stream of pre-vaporized feed (32) will be made to contact the stream of regenerated catalyst in the beginning of the section (12) of the conversion zone.

Preferably the ratio between the mixture of regenerated catalyst and the stream of pre-vaporized hydrocarbon feed (32) which the catalyst contacts in the beginning of section (12) is between 4 and 15, more preferably between 6 and 9.

The residence time of the catalyst particles in the reaction zone varies between 0.05 and 5 seconds, preferably between 0.5 and 2 seconds.

Before the contact with the catalyst, the temperature of the pre-vaporized feed attains 350 to 650° C., more preferably between 400 and 550° C. Therefore, the heat requirement will only be a function of the endothermic character of the cracking reactions; as a consequence, an undesirable increase in temperature may occur in the higher portion of the reaction zone (12), so as to alter the heat balance of the FCC unit.

To effect the control of the final reaction temperature a fluid quench stream (30) is used. The quench stream may be water, steam, naphtha, fuel gas or still other streams used with the same purpose as is well-known by the experts in the area.

The temperature at the end of the reaction zone, which is controlled by adding the quench stream, is situated between 510 and 570° C., preferably between 520 and 560° C.

Alternatively, the quench stream (30) may be added before the feed, in the middle section (9) of the reaction zone, this feature not being a limiting aspect of the invention.

The use of the quench stream will allow the control of the reaction temperature within the limits established for the FCC unit without harm to the catalyst/oil ratio, said ratio being one of the most significant variables for the refiner in terms of output of the FCC unit.

The products of the cracking reaction as well as the spent catalyst are directed, at the end of the reaction zone (12), to reactor (1) where they are separated by means of conventional devices for separating particulate matter. Those devices are made up of parts (13), (14), (15) and (16), the products being directed through conduit (28) to the separation zone and the spent catalyst directed to regenerator (5) through conduit (3), as in conventional FCC processes.

Figure 2:
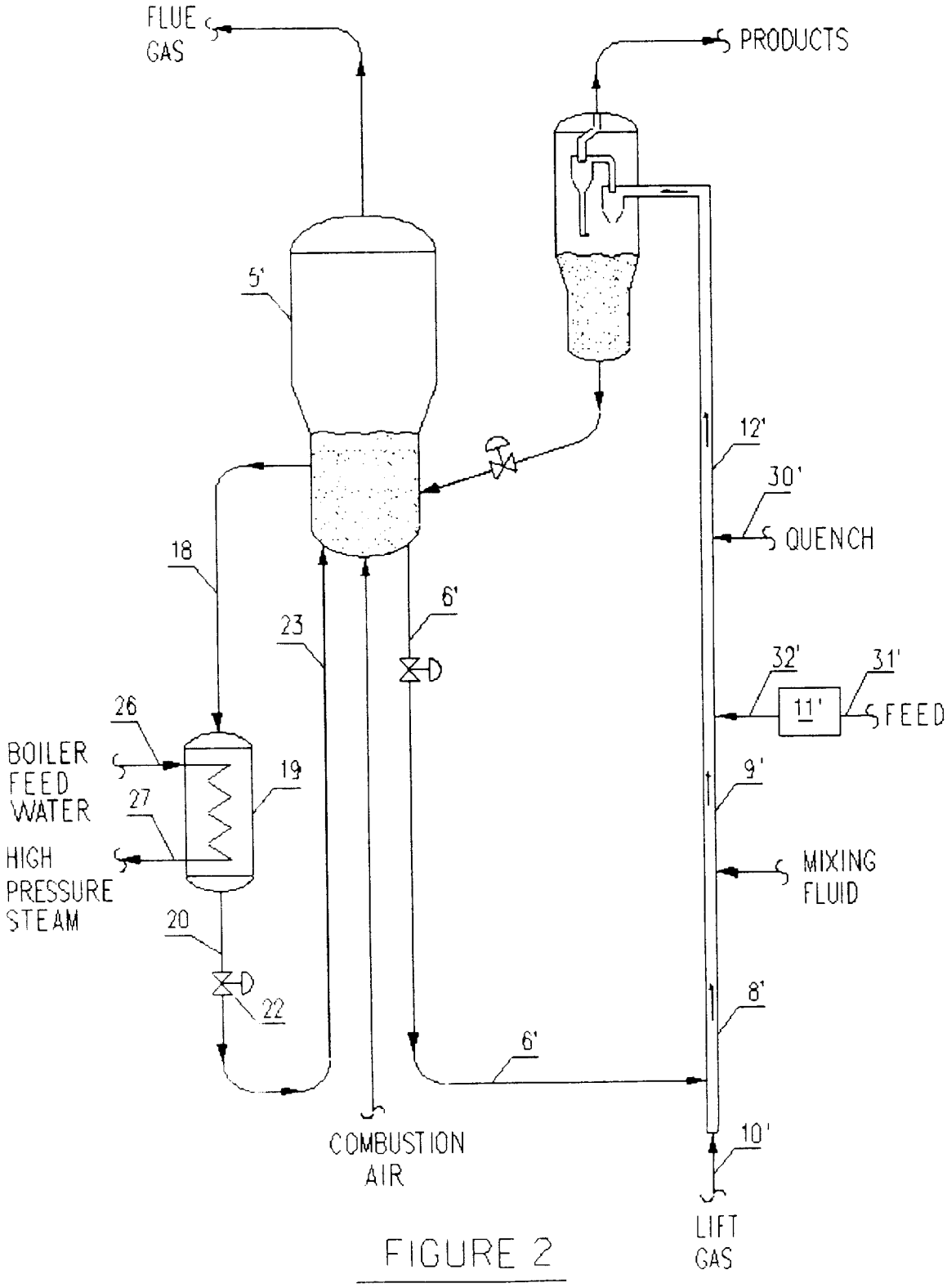
FIG. 2 illustrates another mode of the present invention for the adjustment of the heat balance of the FCC unit operating with the pre-vaporized feed, where the control of the final temperature of reaction is obtained by combining the use of a catalyst cooler and a stream of cooling fluid.

FIG. 2 attached shows another mode for the adjustment of the heat balance of the FCC unit which operates with the pre-vaporized feed, which consists in the combined action of a stream of quench fluid and a catalyst cooler.

Thus, according to said FIGURE, from regenerator (5') extend: a standpipe (6') which directs the hot regenerated catalyst to the lower portion (8') of the reaction zone and a conduit (18) which directs the hot regenerated catalyst to cooler (19). Cooler (19) utilizes as cooling medium a cold fluid which is typically boiler feed water (26), so as to generate high pressure steam (27).

From cooler (19) extends a conduit (20) which by means of control valve (22) which is connected to conduit (23), directs a portion of the cooled regenerated catalyst to the regenerator so as to cool the regenerator bed, keeping it under temperature control.

The hot regenerated catalyst from regenerator (5') through standpipe (6'), is introduced into the lower section (8') of the reaction zone, where it meets the lift gas (10') which keeps said catalyst in a fluidized state.

The stream of pre-vaporized hydrocarbon feed (32') through the heating system (11') meets the regenerated catalyst in the beginning of section (12') of the reaction zone.

The temperature control is then effected by introducing the stream of quench fluid (30'), as mentioned hereinbefore, the addition of quench fluid being also possible into the middle section (9') of the reaction zone, this not being a limiting aspect of the invention.

The advantage of this mode relative to the former is that the amount of quench fluid required for the control of the reaction temperature is less than in the former, which entails more operation flexibility.

According to another preferred mode of the invention, the adjustment of the heat balance of the FCC unit operating with the pre-vaporized feed is obtained using as a source of energy for the heating of the feed, the regenerated catalyst itself, through heat exchange in the catalyst cooler.

Figure 3:
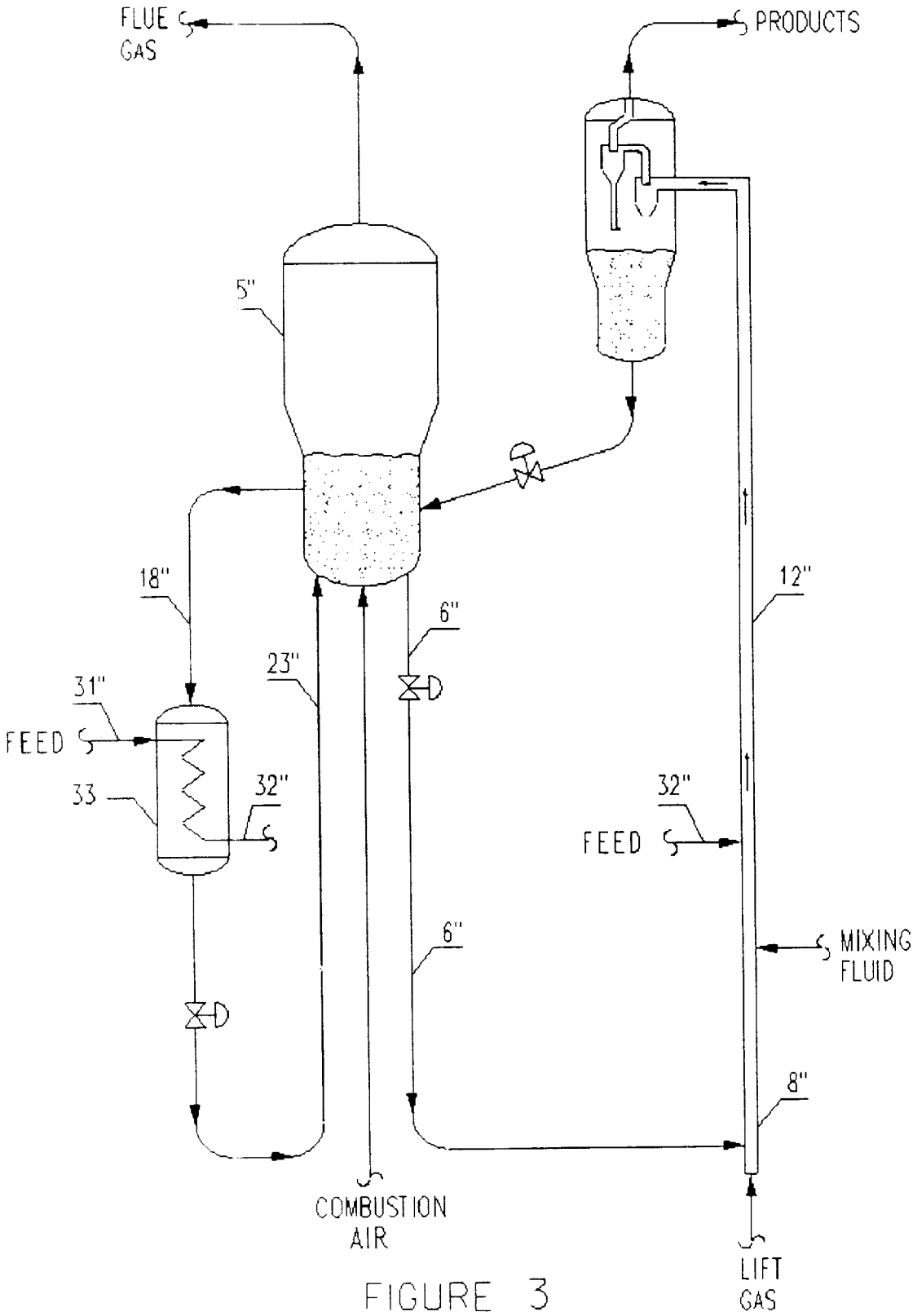
FIG. 3 illustrates another mode of the invention, when the hydrocarbon feed is pre-heated by means of heat exchange with the catalyst which is regenerated with the aid of a catalyst cooler where the cooling fluid is the feed itself of the FCC unit.

Therefore, according to FIG. 3 attached, the stream of hot regenerated catalyst (18") is fed to a catalyst cooler (33) which uses as cooling fluid the feed (31") to the unit itself, which after heat exchange with the regenerated catalyst generates stream (32") which is already partially or completely vaporized. Whenever the heat exchange with the regenerated catalyst in cooler (33) is not sufficient for the complete vaporization of the feed, it may be completely vaporized with the aid of a heating system (11') such as previously shown in FIG. 2.

The catalyst stream is returned to regenerator (5") in a cooled state, through conduit (23"), so as to maintain said vessel under temperature control, in a way similar to that of FIG. 2.

A further preferred mode for the adjustment of the heat balance of the FCC unit operating with a pre-vaporized feed fully incorporates the teachings of EPC patent application 97307435.4 (U.S. patent application Ser. No. 199708/933, 006) of the Applicant, whereby the adjustment of the heat balance is attained through the combined use of two regenerated catalyst streams having different temperatures.

Figure 4:
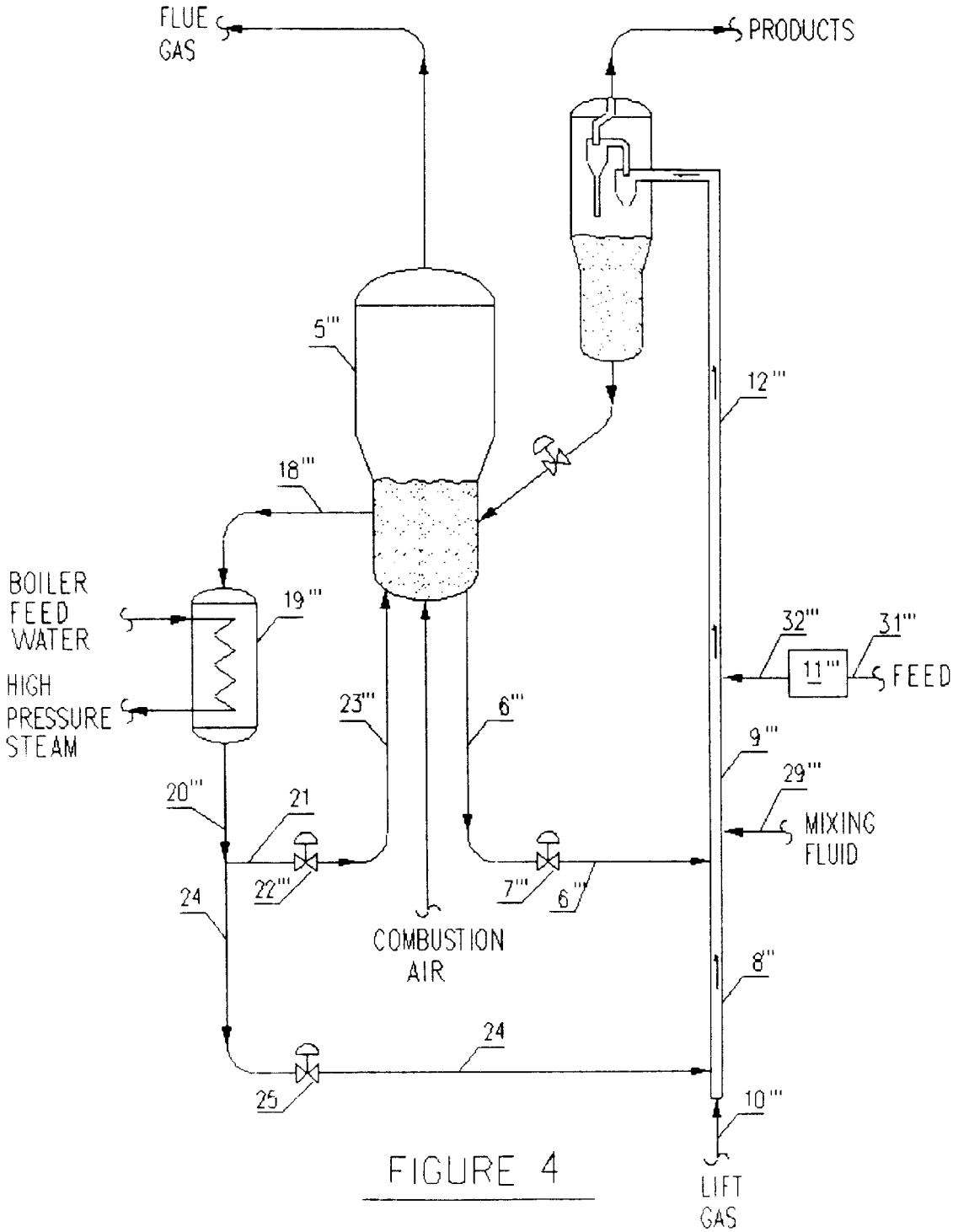
FIG. 4 illustrates one of the modes for the control of the heat balance of the FCC unit operating with pre-vaporized feed, according to EPC 97307435.4 incorporated as reference.

Thus, according to FIG. 4 attached, from regenerator (5''') extend: a standpipe (6''') which conveys hot regenerated catalyst to the lower section (8''') of the reaction zone and a conduit (18''') which conveys hot regenerated catalyst to cooler (19'''). As a cooling medium, cooler (19''') utilizes a cold fluid which is typically boiler feed water which generates high pressure steam.

From cooler (19''') extends a conduit (20''') which is connected to conduit (24) which by means of control valve (25) conveys a portion of the cooled regenerated catalyst to the lower section of the reaction zone (8'''). Lift gas is introduced via a conduit (10''') and contacts the catalyst in the lower section (8''') of the reaction zone, so that the catalyst is kept in the fluidized state.

Conduit (20''') is also connected to conduit (21), which by means of control valve (22'''), connected to conduit (23'''), conveys a portion of the cooled regenerated catalyst to the regenerator so as to cool the regenerator bed.

The mixture between the hotter catalyst stream and the cooler catalyst stream occurs in the middle section (9'''') of the reaction zone.

In order to secure a thorough and quick mixture between both streams of regenerated catalyst, a mixing fluid (29''') is injected through openings radially placed in section (9''').

Since the stream of regenerated catalyst, which is a mixture between streams (6''') and (24) is at a lower temperature than the stream of non-cooled regenerated catalyst of the state-of-the-art technique, the feed may be introduced in reaction zone (12''') completely vaporized before being contacted with the catalyst at a higher temperature than that usually employed in the state-of-the-art technique. Therefore the temperature differential between the catalyst and the feed is substantially lower than in conventional processes, this also preventing the localized heating of the feed. These two effects contribute to reduce undesirable thermal cracking.

The control of the reaction temperature is effected at the end of the reaction zone, generally in the range of 510–570° C., more preferably between 520–560° C. Such control is effected through a conventional device for measuring temperature combined to a controller and to a signal-transmitting device which operates on control valve (7'''), so as to accordingly vary the flow rate of hot regenerated catalyst to the reaction zone.

Each adjustment of the opening of valve (7''') which would affect the catalyst/oil ratio allows another adjustment of the opening of valve (25), so that a different flow rate of cooled regenerated catalyst is admitted to the reaction zone, so as to remake the previous catalyst/oil ratio. This way the heat balance of the unit is adjusted without the need to modify the catalyst/oil ratio.

It is obvious to the experts in the art that the cooling fluid of the catalyst coolers (19) and (19''') may be the feed itself to be directed to the unit such as described in the previous mode of the invention, this possibility being an alternative to the modes according to FIGS. 2 and 4.

It is also obvious to the experts and knowledgeable persons in the art that several variations of these modes are comprised in the scope of the present invention aiming at adjusting the balance of the FCC unit operating with a pre-vaporized feed, such variations do not constituting a limitation of the invention.

The invention will now be better characterized by means of the following Example, which should not be construed as limiting it.

EXAMPLE 1

The hydrocarbon feed having the properties listed in Table 1 was used in this Example, which illustrates one of the preferred modes of the invention, that is, the utilization of an infrared furnace as the source of energy for the pre-vaporization of the feed to a pilot FCC unit.

The infrared furnace used in this Example for the pre-vaporization of the feed is provided with four 1000 W lamps, the total being 4000 W. This furnace allows the homogenous application of this high power to a relatively short portion of 26 cm length. This minimizes the residence time of the feed in the furnace, so as to avoid the formation of hot spots throughout the heating, these hot spots being usual when electrical resistances are employed.

Figure 5:
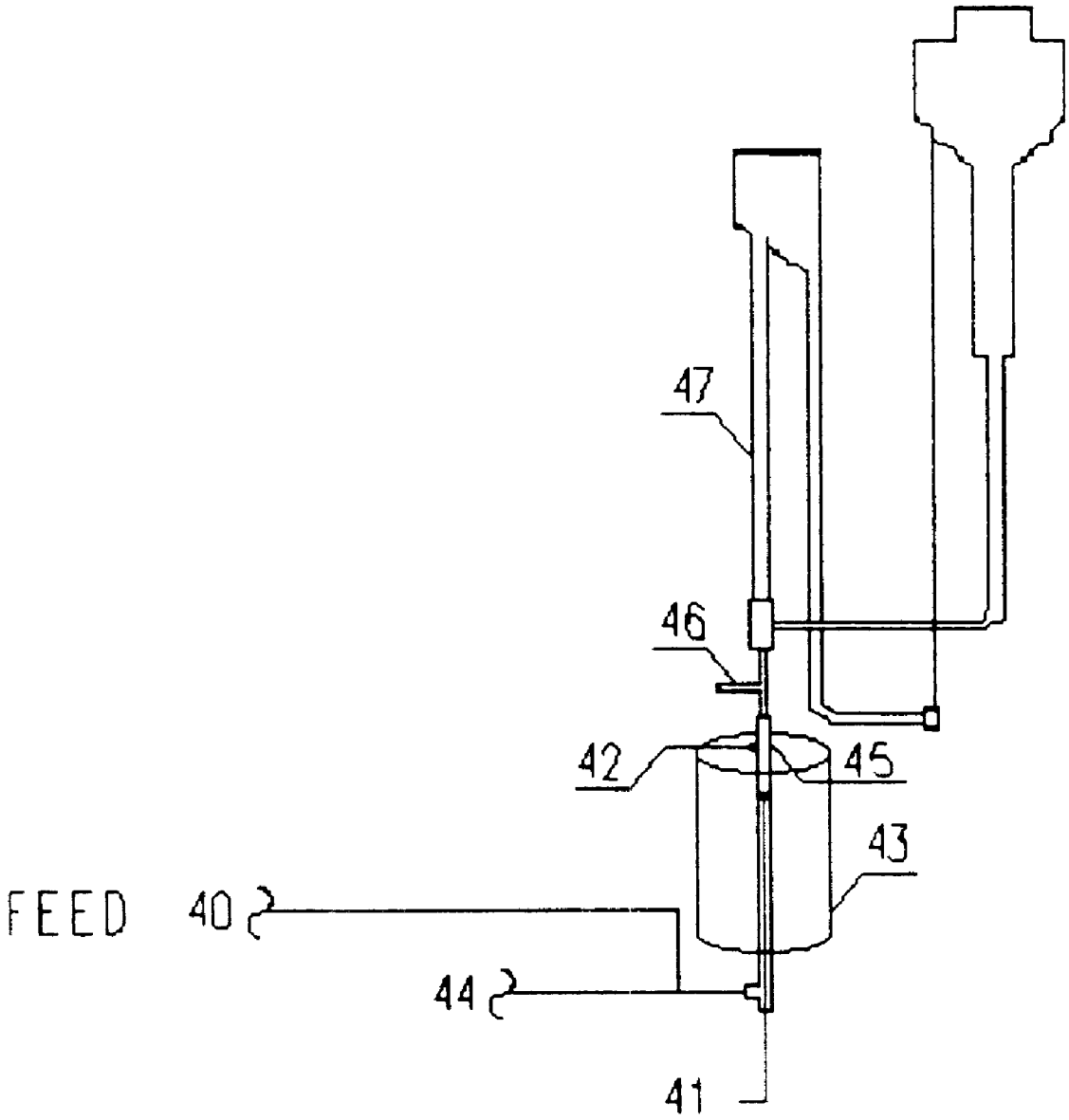
FIG. 5 illustrates the configuration of a pilot FCC unit adapted with an infrared furnace used for the pre-vaporization of the feed.

FIG. 5 shows the arrangement of the pilot FCC unit coupled to the infrared furnace. The stream of cold feed (40) was introduced in the unit together with a stream of inerts (44), added at the furnace entrance aiming at reducing the residence time of the feed. The feed and the inerts flow through an annular section formed by a thermocouple (41) of 1/16" external diameter axially inserted in a tube (45) of 1/4" external diameter. Tube (45) on its turn is connected to feed atomizer (46) so that the residence time between the exit of the furnace and the entrance in the reaction zone of upward flow (47) is reduced.

A second thermocouple (42), positioned on the outer surface of the tube, within the infrared furnace (43), closer to the exit, was in charge of the control of the furnace temperature.

For the sake of comparison, two runs were effected with the gasoil of Table 2, in a pilot catalytic cracking unit. The conditions of the runs were chosen so as to allow a more direct assessment of the effect of the vaporization of the feed on the yields of the FCC pilot unit. Thus, the runs were effected at the following temperatures in the feed furnace: at 250° C. (as a control) and at 540° C.

In order to evaluate the yield profile with conversion, different severity levels of the process were obtained through variation of the catalyst/oil ratio, this being obtained through the variation of the catalyst circulation in the unit. To obtain the yield profile, a simulated distillation according to ASTM D 2887 was used, cuts being made at the following points:

| | |
|---|---|
| Naphtha: | 35–216° C. |
| Light cycle Oil (LCO) | 216–344° C. |
| Decanted Oil (DO) | 344° C. |

The remaining operation conditions were kept constant among the runs.

The degree of vaporization of the feed was calculated with the aid of the PETROBRAS simulator SIMCRAQ$^{OT}$. For the temperature condition 540° C. which was chosen for one of the runs of the FCC pilot unit, the feed is completely vaporized. As for the 250° C. tests, an efficient atomizer was necessary for atomizing the portion of the feed which had not been vaporized, so as not to overestimate the benefits of the pre-vaporization.

An extremely important variable for the control of the fluid catalytic process with the pre-vaporized feed is the residence time between the exit of the furnace and the entrance in the reaction zone, which was reduced as much as possible. It is essential that the feed be quickly submitted to the catalytic process after the increase in temperature, since the severe thermal treatment generates reactive species, maybe free radicals, which vanish in a few minutes.

The formed species should not be given the opportunity to react among themselves, instead, they should remain active towards the catalytic cracking process. Therefore it is advisable and desirable that the residence time between the heating and the catalytic cracking be limited to one minute, more preferably less than 0.1 seconds for the completely vaporized feed.

TABLE 2

| | | |
|---|---|---|
| Feed temperature (° C.) | 540 | 250 |
| Reaction temperature (° C.) | 530 | 530 |
| Conversion (weight %) | 72.7 | 69.8 |
| Catalyst/oil Ratio | 7.0 | 7.0 |
| Δ Coke | 1.24 | 1.31 |
| Yields at iso-coke (weight %) | | |
| Coke | 9.0 | 9.0 |
| Fuel gas | 4.24 | 4.07 |
| Hydrogen | 0.22 | 0.26 |
| Liquefied Petroleum Gas (LPG) | 16.2 | 16.3 |
| Propylene | 5.24 | 4.51 |
| Gasoline | 43.3 | 40.3 |
| Light Cycle Oil (LCO) | 13.5 | 14.6 |
| Decanted Oil | 13.8 | 15.7 |

Data of Table 2 above shows the results of the runs for evaluating the effects of the pre-vaporization of the feed stock in a pilot plant scale.

The iso-coke evaluation has shown that the pre-vaporization of the feed at 540° C. had the following advantages:

A significant, 3,0 weight % increase in the gasoline yield, based on the control run at 250° C.;

A conversion increase of 2.9 weight %;

A decanted oil reduction of 1.9 weight %.

Similar yields in LPG, but significantly higher yields in propylene;

Fuel gas yield not significantly altered;

Coke selectivity directly proportional to the feed temperature used, that is, the higher the feed temperature, the better the coke selectivity by conversion unit.

What is claimed is:

1. A process for fluid catalytic cracking with a pre-vaporized hydrocarbon feed which is to be contacted with a hot regenerated catalyst in a FCC unit, in the absence of added hydrogen, the process comprising the following steps:

pre-vaporizing the hydrocarbon feed under the required temperature and pressure conditions to promote the optimized vaporization of the feed prior to the contact with the hot regenerated catalyst;

in a reaction zone, contacting the pre-vaporized hydrocarbon feed with the catalyst stream from a regenerator, so as to promote the catalytic cracking reaction in the vapor phase, whereby is obtained a mixture of cracked hydrocarbons and spent catalyst;

separating from the so-obtained mixture the stream of spent catalyst, and a stream of cracked hydrocarbon products;

directing the spent separated catalyst which has been separated in the previous step to a stripping zone, then to a regeneration zone and effecting the combustion of the coke deposited on the catalyst particles, so as to obtain particles of regenerated catalyst having a higher activity than the activity of the spent catalyst;

directing the stream of cracked hydrocarbons to a separation and fractionation zone, so as to separate the various hydrocarbon products obtained according to their boiling point; and directing the stream of regenerated catalyst back to the reaction zone so as to continue the fluid catalytic cracking process;

wherein the absolute temperature difference between the temperature at the end of the reaction zone and the temperature of the pre-vaporized feed is 200° C. or less.

2. A process according to claim 1, wherein the hydrocarbon feed is selected from the group consisting of a heavy gasoil (HGO), a residuum of atmospheric distillation (AR), a gasoil from the treatment of shale oil, and mixtures thereof.

3. A process according to claim 2, wherein the final boiling point of the hydrocarbon feed to be pre-vaporized is higher than 580° C.

4. A process according to claim 1, wherein the temperature of the pre-vaporized feed is between 350 and 650° C.

5. A process according to claim 1, wherein the pre-vaporization of the hydrocarbon feed is obtained by means of infrared radiation.

6. A process according to claim 1, wherein the pre-vaporization of the hydrocarbon feed is obtained by applying microwave radiation.

7. A process according to claim 1, wherein the pre-vaporization of the hydrocarbon feed is obtained by heating in industrial furnaces.

8. A process according to claim 7, wherein the industrial furnaces are furnaces from a delayed coking unit, a visbreaking unit and from double fired furnaces.

9. A process according to claim 7, wherein the pre-vaporization of the hydrocarbon feed is obtained by combining non-conventional energy sources and industrial furnaces.

10. A process according to claim 1, wherein the pre-vaporization of the hydrocarbon feed is obtained by combining micro-wave energy sources and industrial furnaces.

11. A process according to claim 1, wherein the flow of catalyst in the reaction zone in the FCC unit is upward.

12. A process according to claim 1, wherein the flow of catalyst in the reaction zone in the FCC unit is downward.

13. A process according to claim 1, wherein the residence time of the catalyst particles in the reaction zone varies between 0.05 and 5 seconds.

14. A process according to claim 1, further comprising adjusting the heat balance of the FCC unit which operates with the pre-vaporized feed through the control of the final reaction temperature by adding a stream of quench fluid (30) into the reaction zone.

15. A process according to claim 14 wherein the quench fluid is added to the reaction zone before introducing the pre-vaporized feed to the reaction zone.

16. A process according to claim 15, wherein the quench stream is selected from the group consisting of steam, fuel gas and naphtha.

17. A process according to claim 14, wherein the quench stream is selected from the group consisting of steam, fuel gas and naphtha.

18. A process according to claim 1, further comprising adjusting the heat balance of the FCC unit which operates with pre-vaporized feed by the control of the reaction temperature by means of the combined addition of a stream of quench fluid (30') to the reaction zone and a catalyst from catalyst cooler (19).

19. A process according to claim 1, further comprising adjusting the heat balance of the FCC unit by the control of the final reaction temperature by utilizing the hydrocarbon feed stock to the unit as a cooling fluid for a catalyst cooler (33).

20. A process according to claim 19, wherein the feed stock (31 ") exchanges heat with the catalyst cooler (33) so as to yield the vaporized feed (32").

21. A process according to claim 1, further comprising adjusting the heat balance of the FCC unit by the control of the final reaction temperature by combining two streams of regenerated catalyst (6''') and (24) before the mixture with the stream of pre-vaporized feed (32''') to be cracked in the reaction zone.

22. A process according to claim 21, wherein the stream of regenerated catalyst (24) has its origin in a catalyst cooler (19'''), the temperature of said stream being lower than that of the regenerated catalyst (6''') which has its origin in regenerator (5''').

23. The process of claim 1, wherein the absolute difference between the temperature at the end of the reaction zone and the temperature of the pre-vaporized feed is 160° C. or less.

24. The process of claim 1, wherein the absolute difference between the temperature at the end of the reaction zone and the temperature of the pre-vaporized feed is 110° C. or less.

25. The process of claim 1 wherein the absolute difference between the temperature at the end of the reaction zone and the temperature of the pre-vaporized feed is 10° C. or less.

26. A process for fluid catalytic cracking with a pre-vaporized hydrocarbon feed which is to be contacted with a hot regenerated catalyst in a FCC unit, in the absence of added hydrogen, said process not employing an atomizer and comprising the following steps:

pre-vaporizing the hydrocarbon feed without the use of an atomizer and under the required temperature and pressure conditions to promote the optimized vaporization of the feed prior to the contact with the hot regenerated catalyst;

in a reaction zone, contacting the pre-vaporized hydrocarbon feed with the catalyst stream from a regenerator, so as to promote the catalytic cracking reactions in the vapor phase, whereby is obtained a mixture of cracked hydrocarbons and spent catalyst;

separating from the so-obtained mixture the stream of spent catalyst, and a stream of cracked hydrocarbon products;

directing the spent separated catalyst which has been separated in the previous step to a stripping zone, then to a regeneration zone and effecting the combustion of the coke deposited on the catalyst particles, so as to obtain particles of regenerated catalyst having a higher activity than the activity of the spent catalyst;

directing the stream of cracked hydrocarbons to a separation and fractionation zone so as to separate the various hydrocarbon products obtained according to their boiling point; and directing the stream of regenerated catalyst back to the reaction zone so as to continue the fluid catalytic cracking process, wherein the absolute difference between the temperature at the end of the reaction zone and the temperature of the pre-vaporized feed is 220° C. or less.

27. The process of claim 26, wherein the absolute difference between the temperature at the end of the reaction zone and the temperature of the pre-vaporized feed is 160° C. or less.

28. The process of claim 26, wherein the absolute difference between the temperature at the end of the reaction zone and the temperature of the pre-vaporized feed is 110° C. or less.

29. The process of claim 26, wherein the absolute difference between the temperature at the end of the reaction zone and the temperature of the pre-vaporized feed is 10° C. or less.

* * * * *